US010827834B2

(12) United States Patent
Wantland et al.

(10) Patent No.: US 10,827,834 B2
(45) Date of Patent: Nov. 10, 2020

(54) BOTTLE SUPPORT ASSEMBLY FOR A REFRIGERATOR APPLIANCE

(71) Applicant: Haier US Appliance Solutions, Inc., Wilmington, DE (US)

(72) Inventors: Louis A. Wantland, Louisville, TX (US); Bagawathkumar Chellappan, Prospect, TX (US); Stephanos Kyriacou, Louisville, KY (US); Brent Alden Junge, Evansville, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 16/166,306

(22) Filed: Oct. 22, 2018

(65) Prior Publication Data

US 2020/0121080 A1 Apr. 23, 2020

(51) Int. Cl.

| | |
|---|---|
| ***A47B 43/00*** | (2006.01) |
| ***A47B 73/00*** | (2006.01) |
| ***F25D 25/02*** | (2006.01) |

(52) U.S. Cl.

CPC ..... *A47B 73/008* (2013.01); *A47B 43/00* (2013.01); *F25D 25/025* (2013.01)

(58) Field of Classification Search

CPC ..... A47B 43/00; A47B 73/00; A47B 73/008; F25D 25/025

USPC ..... 312/401, 404, 408, 410; 211/41.5, 41.6, 211/74

See application file for complete search history.

(56) References Cited

U.S. PATENT DOCUMENTS

| | | | | |
|---|---|---|---|---|
| 946,977 | A * | 1/1910 | Muller | |
| 5,819,937 | A * | 10/1998 | Walker | A47B 73/00 206/429 |
| 7,886,917 | B1 * | 2/2011 | Berger | A47B 81/04 211/85.31 |
| 8,925,742 | B1 * | 1/2015 | Chitayat | A47L 19/04 211/41.6 |
| 8,960,452 | B2 * | 2/2015 | Rhodes, II | A47L 19/04 211/41.6 |
| 2004/0149668 | A1 * | 8/2004 | Fann | A47B 73/002 211/74 |
| 2005/0017617 | A1 * | 1/2005 | Becke | A47F 3/0434 312/404 |
| 2005/0040120 | A1 * | 2/2005 | Pine | A47L 19/04 211/41.6 |
| 2005/0258118 | A1 * | 11/2005 | Lee | A47B 55/02 211/134 |

(Continued)

FOREIGN PATENT DOCUMENTS

| | | | |
|---|---|---|---|
| AU | 2015101442 | A4 | 11/2015 |
| CN | 2755520 | Y | 2/2006 |

(Continued)

*Primary Examiner* — James O Hansen

(74) *Attorney, Agent, or Firm* — Dority & Manning, P.A.

(57) ABSTRACT

A bottle support assembly positioned within a chilled chamber of a refrigerator appliance includes a support panel, a first support, and a second support. Each of the first support and the second support are pivotally mounted to the support panel and are movable between a collapsed position and a raised position. In addition, the first support and the second support each define concave support surfaces which may be positioned at different heights and may have different radiuses of curvature for supporting bottles having any size and at any angle.

15 Claims, 6 Drawing Sheets

(56) References Cited

U.S. PATENT DOCUMENTS

| | | | | |
|---|---|---|---|---|
| 2006/0255704 | A1* | 11/2006 | Grobleben | F25D 25/021 312/408 |
| 2007/0125240 | A1* | 6/2007 | Kasden | A47J 47/16 99/372 |
| 2013/0105423 | A1* | 5/2013 | Chalifoux | A47J 47/005 211/41.5 |
| 2014/0263111 | A1* | 9/2014 | Micek | A47L 19/04 211/41.6 |
| 2016/0037917 | A1* | 2/2016 | Li | A47B 73/006 211/74 |
| 2017/0234604 | A1* | 8/2017 | Eicher | A47B 57/545 312/330.1 |

FOREIGN PATENT DOCUMENTS

| | | | | | |
|---|---|---|---|---|---|
| CN | 201803566 | U | | 4/2011 | |
| CN | 201897358 | U | | 7/2011 | |
| CN | 102494502 | | * | 6/2012 | F25D 25/02 |
| CN | 204027185 | U | | 12/2014 | |
| CN | 103829626 | B | | 5/2016 | |
| DE | 19631374 | | * | 2/1998 | A47B 73/00 |

* cited by examiner

BOTTLE SUPPORT ASSEMBLY FOR A REFRIGERATOR APPLIANCE

FIELD OF THE INVENTION

The present subject matter relates generally to refrigerator appliances, and more particularly to shelf assemblies including collapsible wine racks for use in refrigerator appliances.

BACKGROUND OF THE INVENTION

Refrigerator appliances generally include a cabinet that defines a chilled chamber for receipt of food articles for storage. In addition, refrigerator appliances include one or more doors rotatably hinged to the cabinet to permit selective access to food items stored in chilled chamber(s). The refrigerator appliances can also include various storage components mounted within the chilled chamber and designed to facilitate storage of food items therein. Such storage components can include racks, bins, shelves, or drawers that receive food items and assist with organizing and arranging of such food items within the chilled chamber.

However, certain refrigerated drinks are commonly stored in containers which are not easily accommodated by conventional refrigerator shelves or bins. For example, wine bottles are often too tall to store in a vertical orientation due to the vertical spacing of shelves. Wine bottles could instead be placed in a horizontal orientation on a shelf of the refrigerator, but would be prone to rolling around on the shelf. Moreover, it is frequently desirable to store wine bottles at a slight negative incline, e.g., to keep the cork exposed to wine to prevent it from drying out. Regardless of the positioning in conventional refrigerator appliances, wine bottles are typically not well presented and are often difficult to view or access, particularly when the labels are facing down or the bottle has rolled to the back of the shelf.

Accordingly, a refrigerator appliance with features for improving storage of and access to tall drink bottles stored within the chilled chamber of the refrigerator appliance would be useful. More specifically, a refrigerator appliance with shelf assemblies including nested, collapsible wine racks for receiving wine bottles would be particularly beneficial.

BRIEF DESCRIPTION OF THE INVENTION

Aspects and advantages of the invention will be set forth in part in the following description, or may be apparent from the description, or may be learned through practice of the invention.

In a first exemplary embodiment, a refrigerator appliance includes a cabinet defining a chilled chamber, a door being operably coupled to the cabinet to provide selective access to the chilled chamber, and a bottle support assembly positioned within the chilled chamber. The bottle support assembly includes a support panel, a first support pivotally mounted to the support panel and being movable between a collapsed position and a raised position, the first support defining a first concave support surface for receiving a first end of a bottle when the first support is in the raised position, and a second support pivotally mounted to the support panel and being movable between a collapsed position and a raised position, the second support defining a second concave support surface for receiving a second end of the bottle when the second support is in the raised position.

According to another exemplary embodiment, a bottle support assembly includes a support panel, a first support pivotally mounted to the support panel and being movable between a collapsed position and a raised position, the first support defining a first concave support surface for receiving a first end of a bottle when the first support is in the raised position, and a second support pivotally mounted to the support panel and being movable between a collapsed position and a raised position, the second support defining a second concave support surface for receiving a second end of the bottle when the second support is in the raised position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
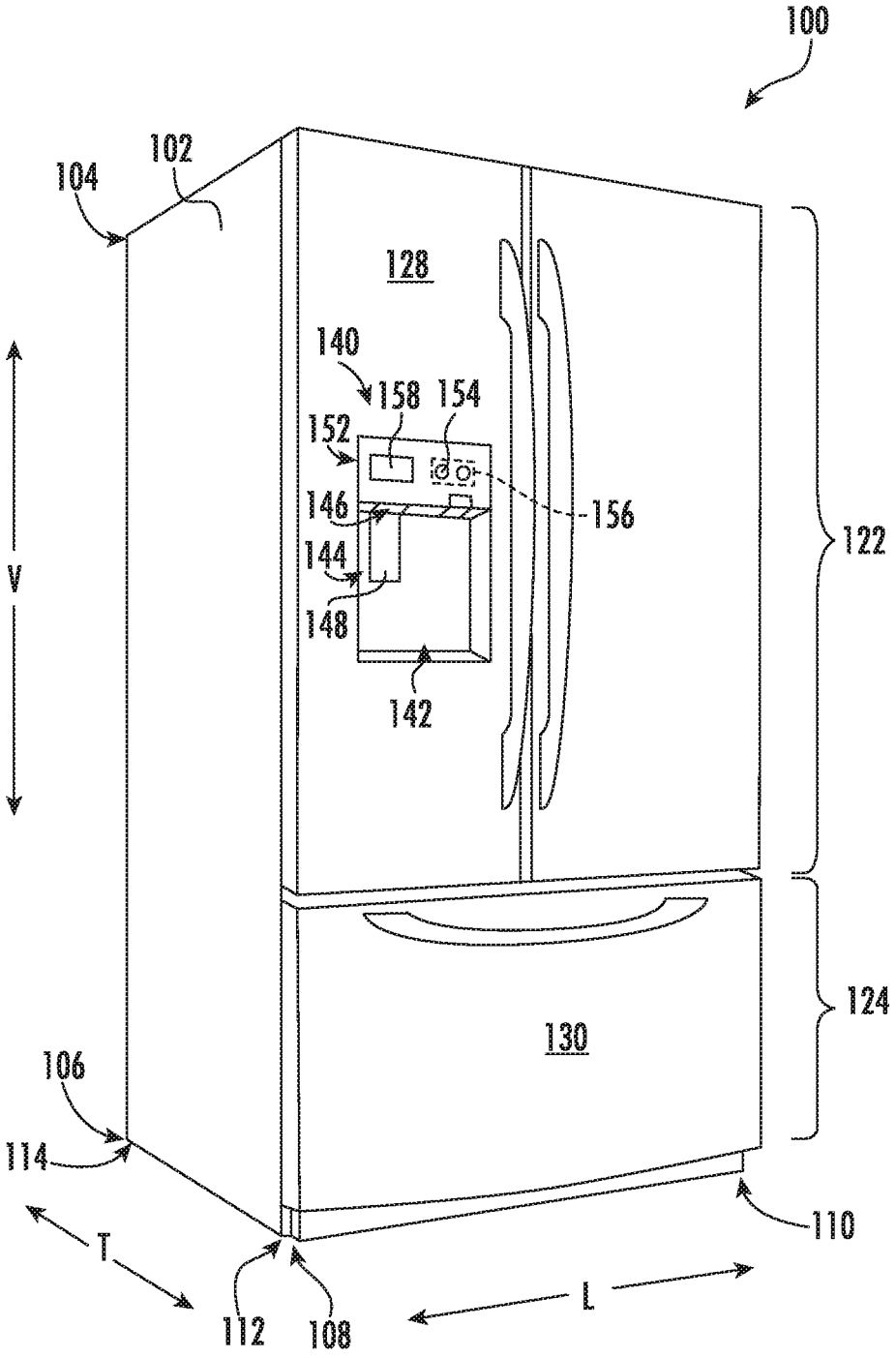
FIG. 1 provides a perspective view of a refrigerator appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a refrigerator appliance 100 according to an exemplary embodiment of the present subject matter. Refrigerator appliance 100 includes a cabinet or housing 102 that extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another, such that an orthogonal coordinate system is generally defined.

Housing 102 defines chilled chambers for receipt of food items for storage. In particular, housing 102 defines fresh food chamber 122 positioned at or adjacent top 104 of housing 102 and a freezer chamber 124 arranged at or adjacent bottom 106 of housing 102. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance, a side-by-side style refrigerator appliance, or a single door refrigerator appliance. Moreover, aspects of the present subject matter may be applied to other appliances as well, such as ovens, microwaves, etc. Consequently, the description set forth herein is for illustrative purposes only and is not intended to be limiting in any aspect to any particular appliance or configuration.

Refrigerator doors 128 are rotatably hinged to an edge of housing 102 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in the closed configuration in FIG. 1. One skilled in the art will appreciate that other chamber and door configurations are possible and within the scope of the present invention.

Figure 2:
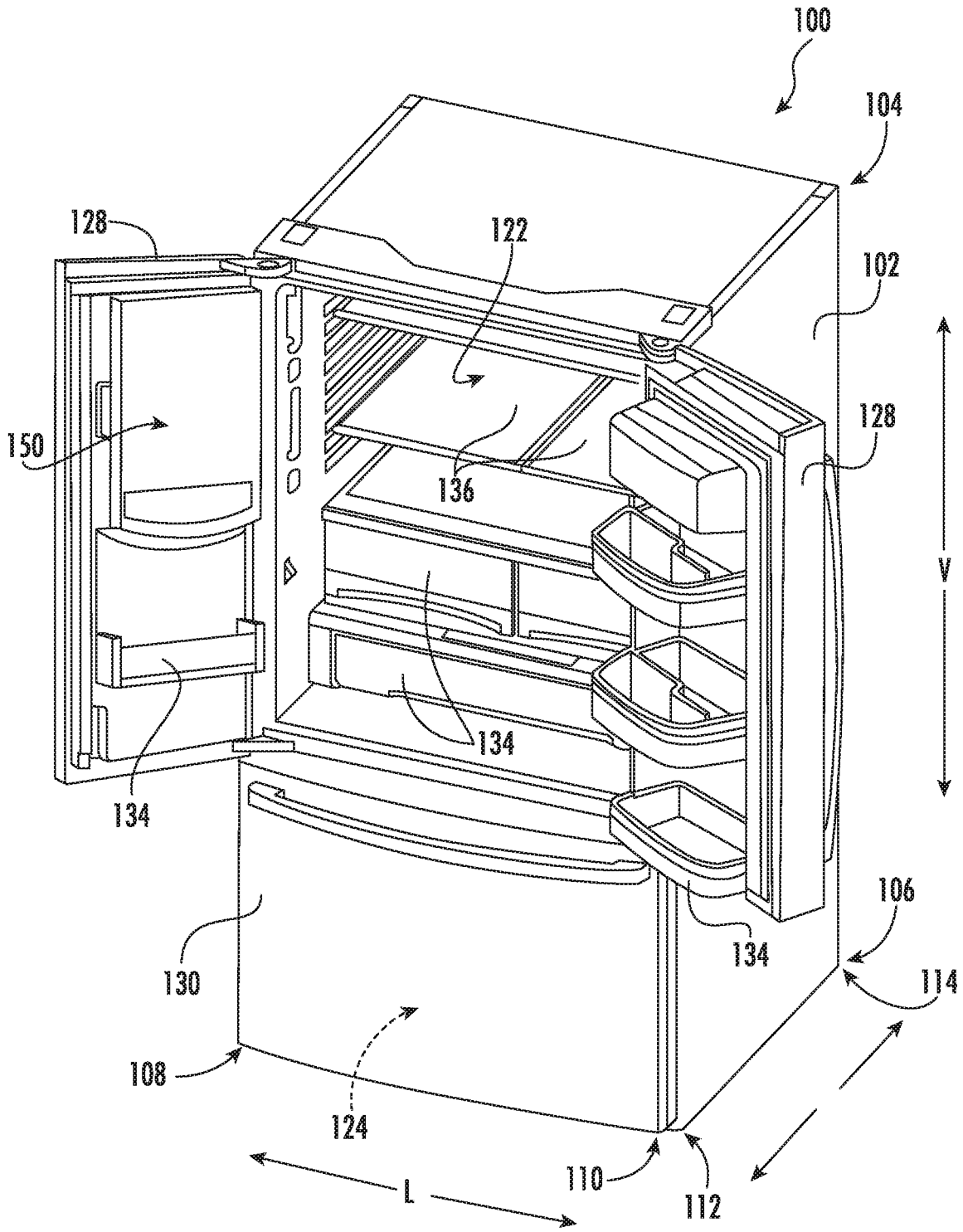
FIG. 2 provides a perspective view of the exemplary refrigerator appliance of FIG. 1, with the doors of the fresh food chamber shown in an open position.

FIG. 2 provides a perspective view of refrigerator appliance 100 shown with refrigerator doors 128 in the open position. As shown in FIG. 2, various storage components are mounted within fresh food chamber 122 to facilitate storage of food items therein as will be understood by those skilled in the art. In particular, the storage components may include bins 134 and shelves 136. Each of these storage components are configured for receipt of food items (e.g., beverages and/or solid food items) and may assist with organizing such food items. As illustrated, bins 134 may be mounted on refrigerator doors 128 or may slide into a receiving space in fresh food chamber 122. It should be appreciated that the illustrated storage components are used only for the purpose of explanation and that other storage components may be used and may have different sizes, shapes, and configurations.

Referring again to FIG. 1, a dispensing assembly 140 will be described according to exemplary embodiments of the present subject matter. Although several different exemplary embodiments of dispensing assembly 140 will be illustrated and described, similar reference numerals may be used to refer to similar components and features. Dispensing assembly 140 is generally configured for dispensing liquid water and/or ice. Although an exemplary dispensing assembly 140 is illustrated and described herein, it should be appreciated that variations and modifications may be made to dispensing assembly 140 while remaining within the present subject matter.

Dispensing assembly 140 and its various components may be positioned at least in part within a dispenser recess 142 defined on one of refrigerator doors 128. In this regard, dispenser recess 142 is defined on a front side 112 of refrigerator appliance 100 such that a user may operate dispensing assembly 140 without opening refrigerator door 128. In addition, dispenser recess 142 is positioned at a predetermined elevation convenient for a user to access ice and enabling the user to access ice without the need to bend-over. In the exemplary embodiment, dispenser recess 142 is positioned at a level that approximates the chest level of a user.

Dispensing assembly 140 includes an ice dispenser 144 including a discharging outlet 146 for discharging ice from dispensing assembly 140. An actuating mechanism 148, shown as a paddle, is mounted below discharging outlet 146 for operating ice or water dispenser 144. In alternative exemplary embodiments, any suitable actuating mechanism may be used to operate ice dispenser 144. For example, ice dispenser 144 can include a sensor (such as an ultrasonic sensor) or a button rather than the paddle. Discharging outlet 146 and actuating mechanism 148 are an external part of ice dispenser 144 and are mounted in dispenser recess 142. By contrast, refrigerator door 128 may define an icebox compartment 150 (FIG. 2) housing an icemaker and an ice storage bin (not shown) that are configured to supply ice to dispenser recess 142.

A control panel 152 is provided for controlling the mode of operation. For example, control panel 152 includes one or more selector inputs 154, such as knobs, buttons, touch-screen interfaces, etc., such as a water dispensing button and an ice-dispensing button, for selecting a desired mode of operation such as crushed or non-crushed ice. In addition, inputs 154 may be used to specify a fill volume or method of operating dispensing assembly 140. In this regard, inputs 154 may be in communication with a processing device or controller 156. Signals generated in controller 156 operate refrigerator appliance 100 and dispensing assembly 140 in response to selector inputs 154. Additionally, a display 158, such as an indicator light or a screen, may be provided on control panel 152. Display 158 may be in communication with controller 156, and may display information in response to signals from controller 156.

As used herein, "processing device" or "controller" may refer to one or more microprocessors or semiconductor devices and is not restricted necessarily to a single element. The processing device can be programmed to operate refrigerator appliance 100, dispensing assembly 140 and other components of refrigerator appliance 100. The processing device may include, or be associated with, one or more memory elements (e.g., non-transitory storage media). In some such embodiments, the memory elements include electrically erasable, programmable read only memory (EEPROM). Generally, the memory elements can store information accessible processing device, including instructions that can be executed by processing device. Optionally, the instructions can be software or any set of instructions and/or data that when executed by the processing device, cause the processing device to perform operations.

Referring now generally to FIGS. 3 through 6, a bottle support assembly 200 which may be used with refrigerator appliance 100 will be described according to exemplary embodiments of the present subject matter. Specifically, bottle support assembly 200 may be positioned within one or more bins 134 or on one or more shelves 136 of refrigerator appliance 100 for supporting items within refrigerator appliance 100. Specifically, as described herein, bottle support assembly 200 is configured for supporting wine bottles 202 (see, e.g., FIG. 5). However, it should be appreciated that bottle support assembly 200 may be used to support or display any bottle having any suitable contents, size, orientation, or configuration. Moreover, bottle support assembly 200 could alternatively be used to support any elongated food item or article within refrigerator appliance 100. Indeed, bottle support assembly 200 might even be used external to an appliance, e.g., as a standalone wine rack. Thus, the exemplary embodiments described herein are not intended to limit the scope of the present subject matter in any manner.

As illustrated, bottle support assembly 200 generally includes a support panel 204 positioned within a chilled chamber of refrigerator appliance, e.g., in fresh food chamber 122. In general, support panel 204 may be any suitably rigid component extending substantially along a horizontal direction (e.g., as defined by the lateral direction L and the transverse direction T) for supporting wine bottles 202. In this regard, for example, support panel 204 may be constructed in whole or in part from plastic, acrylic glass, or any other suitably rigid materials or combinations thereof.

According to exemplary embodiments, support panel 204 is positioned on shelf 136. However, according to alternative embodiments, support panel 204 may replace shelf 136, may be directly mounted to a vertical support track (not shown) through shelf support brackets 210, or may be positioned in refrigerator appliance 100 in any other suitable manner. Specifically, for example, shelf support brackets 210 may extend along the transverse direction T from rear side 114 of cabinet 102 in a cantilevered manner for supporting shelf 136 and/or support panel 204. In this regard, shelf support brackets 210 may be constructed of a rigid material, such as metal, for supporting the weight of shelves shelf 136, support panel 204, and/or stored wine bottles 202.

Figure 3:
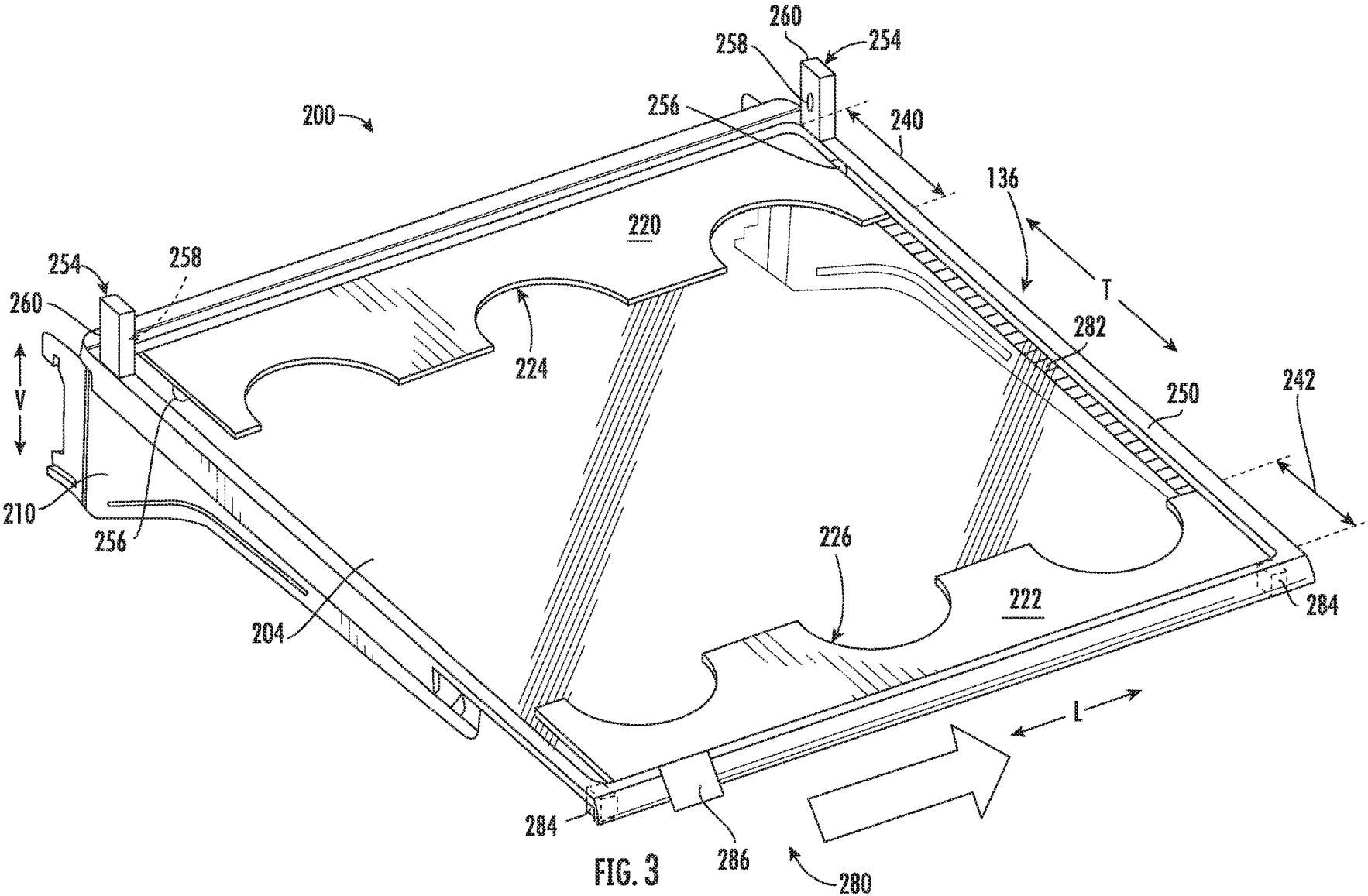
FIG. 3 provides a perspective view of a bottle support assembly that may be positioned on a shelf of the exemplary refrigerator appliance of FIG. 1 according to an exemplary embodiment of the present subject matter, with the bottle support assembly being in a collapsed configuration.
Figure 4:
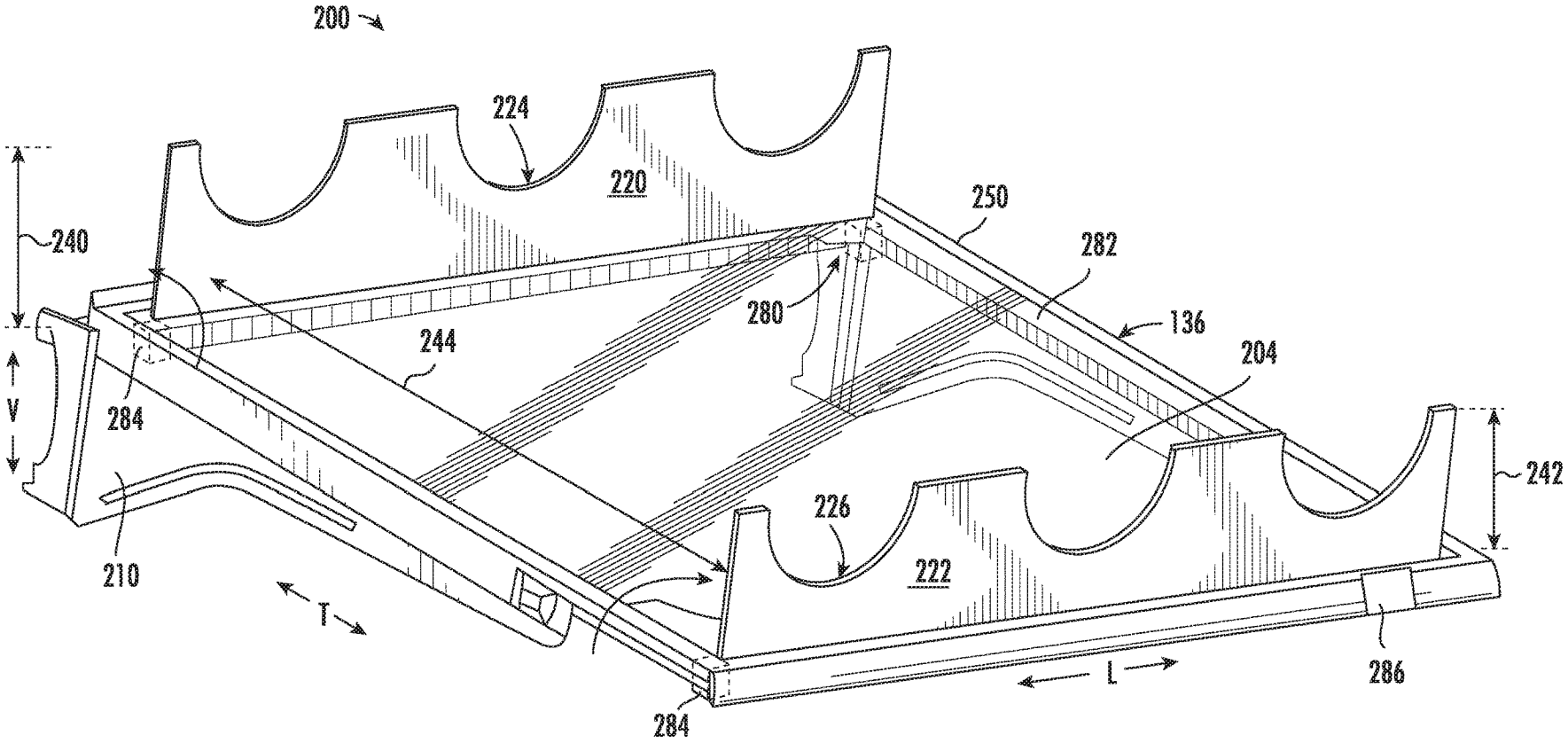
FIG. 4 provides a perspective view of the exemplary bottle support assembly of FIG. 3 in a raised configuration.
Figure 5:
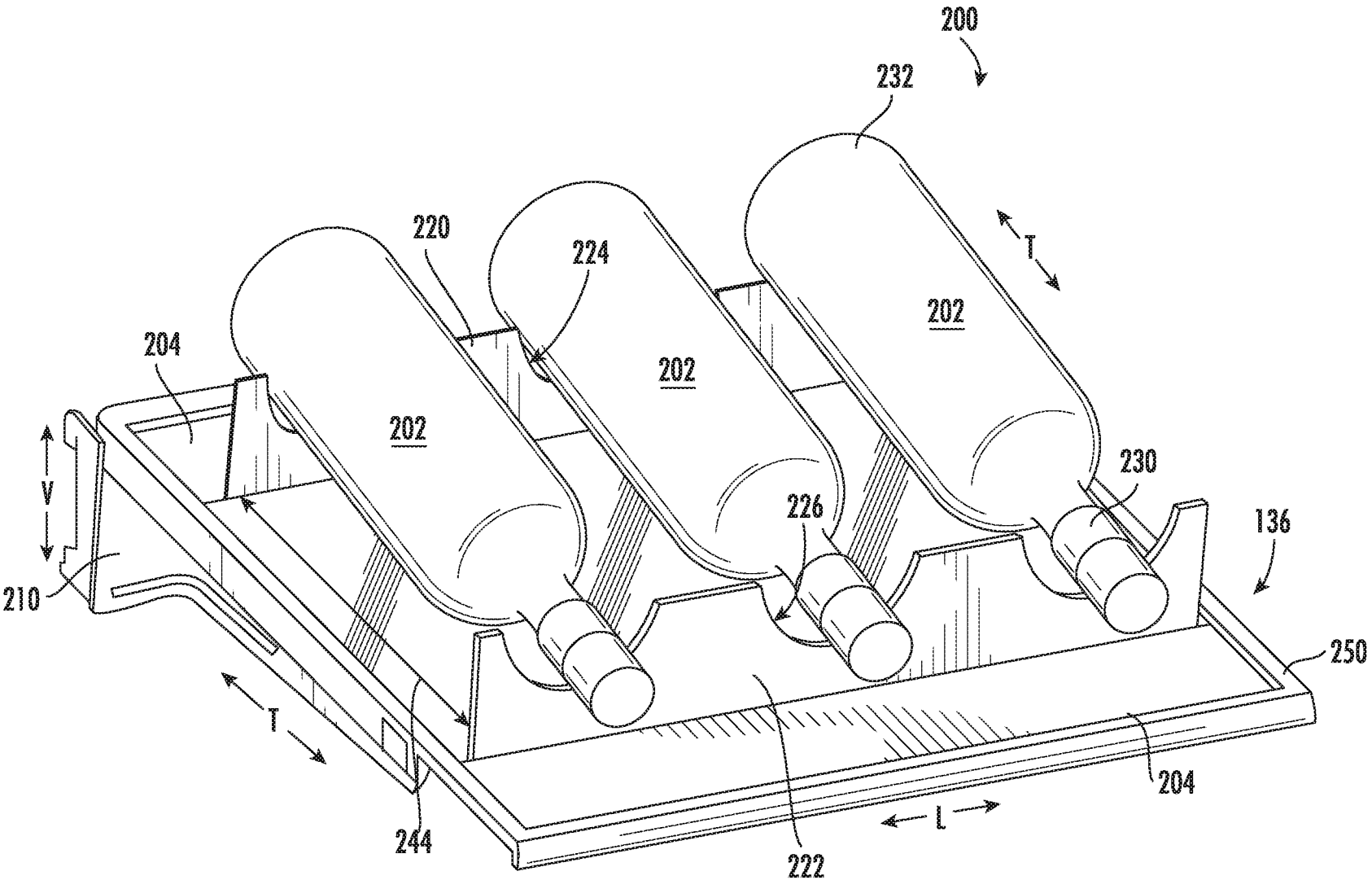
FIG. 5 provides a perspective view of the exemplary bottle support assembly of FIG. 3 in a raised configuration and supporting multiple bottles.

Bottle support assembly 200 may further include a first support 220 and a second support 222 which are pivotally mounted to support panel 204 and are movable between a collapsed position (e.g., as shown in FIG. 3) and a raised position (e.g., as shown in FIGS. 4 and 5). In addition, each of first support 220 and second support 222 may define one or more concave surfaces, grooves, indentations, or other recessed features for receiving and supporting wine bottles 202. Specifically, as illustrated, first support 220 defines a plurality (e.g., three) of first concave support surfaces 224 while second support 222 defines a plurality (e.g., three) of second concave support surfaces 226.

According to the illustrated embodiment, first support 220 is positioned proximate rear side 114 of cabinet 102 and second support 222 is positioned proximate front side 112 of cabinet 102. Notably each of first concave support surfaces 224 and second concave support surfaces 226 may define any suitable radius of curvature R for securely receiving a portion of the wine bottle 202. For example, if it is preferable that a neck 230 of each of the wine bottles 202 is displayed proximate a front of fresh food chamber 122, the radius of curvature R of second concave support surfaces 226 may be smaller than the radius of curvature R for first concave support surfaces 224. A base 232 of the wine bottles may then be received in second concave support surfaces. It should be appreciated that each concave support surface 224, 226 may have a separate size for receiving different size bottles.

In addition, although the illustrated embodiment shows first concave support surfaces 224 and second concave support services 226 as being semicircular cutouts defined in first support 220 and second support 222, respectively, it should be appreciated that the support surfaces can have any other profile, size, or features for engaging wine bottle 202. For example, as explained briefly above, first support 220 and second support 222 could include any suitably shaped groove or recessed feature, such as a V-shaped notch, rectangular groove, etc. In addition, according to an alternative embodiment, concave support services 224, 226 could include a tacky or gripping material that prevents sliding or rotation of wine bottles 202. Alternatively, concave support surfaces 224, 226 could include a support cushion or a foam insert for receiving wine bottles 204. According to still other embodiments, first support 220 and second support 222 could extend over only a portion of a width of shelf 136 (e.g., measured along the lateral direction L) and/or could slide laterally to a suitable position.

As best shown in FIGS. 4 and 5, first support 220 may define a first height 240 measured between support panel 204 and a top of first support 220 substantially along the vertical direction V. In addition, second support 222 may define a second height 242 measured between support panel 204 and a top of second support 222 substantially along the vertical direction V. According to exemplary embodiments, first height 240 and second height 242 may be different, e.g., to permit wine bottles 204 to be stored on an incline or to compensate for wine bottles 204 having varying cross sections along the bottle. Specifically, as illustrated, second height 242 is less than the first height 240, such that neck 230 of wine bottles 204 may be angled down toward a front of fresh food chamber 122, e.g., to ensure the cork remains in contact with wine to prevent drying out, cracking, air entry, etc. In addition, angled wine bottles 204 may typically display better to the user than horizontal bottles. It should be appreciated that as used herein, terms of approximation, such as "approximately," "substantially," or "about," refer to being within a ten percent margin of error.

In addition, first support 220 and second support 222 may be spaced apart by a longitudinal distance 244, e.g., measured between first support 220 and second support 222 along the transverse direction T when in the raised position. Notably, longitudinal distance 244 may vary in order to facilitate the storage of wine bottles 204 having different lengths or for supporting such bottles at different locations. For example, as shown in FIGS. 3 and 4, first support 220 and second support 222 pivot from the front and rear ends of support panel 204 such that there is a larger spacing than that shown in FIG. 5, where first support 220 and second support 222 are offset from the front and rear edge of shelf 136.

Although FIGS. 3 through 6 illustrated first support 220 and second support 222 as being spaced apart along the transverse direction T by a longitudinal distance 244 and extending substantially along the vertical direction V when raised, it should be appreciated that other configurations are possible and within the scope of the present subject matter. For example, first support 220 and second support 222 could pivot from the same location in the middle of shelf 136 along the transverse direction T. In this regard, first support 220 and second support 220 may share single hinge that extends along the lateral direction L and may pivot between a collapsed position (e.g., where they are flat or lie in a horizontal plane) and a raised position (e.g., where they form a V-shaped support structure.

Referring generally to FIGS. 3 through 6, support panel 204 and/or shelf 136 may further included a ridge or raised lip 250 that extends around a perimeter of support panel 204 and/or shelf 136 to contain spills. In addition, according to alternative embodiments, a portion of support panel 204 and/or shelf 136 may be treated with a hydrophobic coating (not shown), e.g., to contain spills. Specifically, for example, a small band of hydrophobic coating may be positioned on a top surface of support panel 204 and/or shelf 136, e.g., around its perimeter. In this manner, for example, liquids spilled in a center of support panel 204 and/or shelf 136 have a tendency to be contained by the hydrophobic coating.

Referring now specifically to FIG. 3, bottle support assembly 200 may further include a locking mechanism 254 for securing first support 220 and second support 222 in the collapsed or raised position. Specifically, according to the illustrated embodiment, locking mechanism 254 (which is shown only for first support 220 in FIG. 3 for clarity of illustration) includes a protruding feature 256 defined on first support 220 and a complementary recess 258 defined by a locking arm 260 which extends upward from support panel 204. Thus, when first support 204 is moved toward the raised position, protruding feature 256 may snap into complementary recess 258 to fix first support 220 in the raised position. It should be appreciated that although protruding feature 256 is illustrated on first support 220 and complementary recess 258 on locking arms, these features could be reversed while remaining within the scope of the present subject matter.

According to the illustrated embodiment, protruding feature 256 is a simple bump defined on one side of first support 220 while complementary feature 258 is a small divot for receiving the bump. However, it should be appreciated that according to alternative embodiments, any other suitable locking feature or locking mechanism 254 may be used. Specifically, for example, locking mechanism 254 may be a mechanical snap, a spring-loaded locking feature, a pivoting locking clasp, a locking magnet assembly, or any other suitable feature or features for temporarily preventing motion of first support 220 and/or second support 222. All of these variations and modifications are contemplated as within the scope of the present subject matter.

According to exemplary embodiments, bottle support assembly 200 may be formed from any material which is sufficiently rigid to support the weight of wine bottles 204 or other supported items. In addition, it may be desirable to form bottle support assembly 200 as a single piece, in which case using a resilient material may permit first support 220 and second support 222 to pivot relative to support panel 204. In such as case, bottle support assembly 200 may be formed by injection molding, e.g., using a suitable plastic material, such as injection molding grade high impact polystyrene (HIPS) or acrylonitrile butadiene styrene (ABS). Alternatively, according to the exemplary embodiment, bottle support assembly 200 may be compression molded, e.g., using sheet molding compound (SMC) thermoset plastic. According to alternative embodiments, support panel 204, first support 220, and second support 222 may be separately manufactured and joined together. For example, support panel 204 could be a piece of acrylic glass and first support 220 and second support 222 could be mounted thereon using a hinge mechanism.

Figure 6:
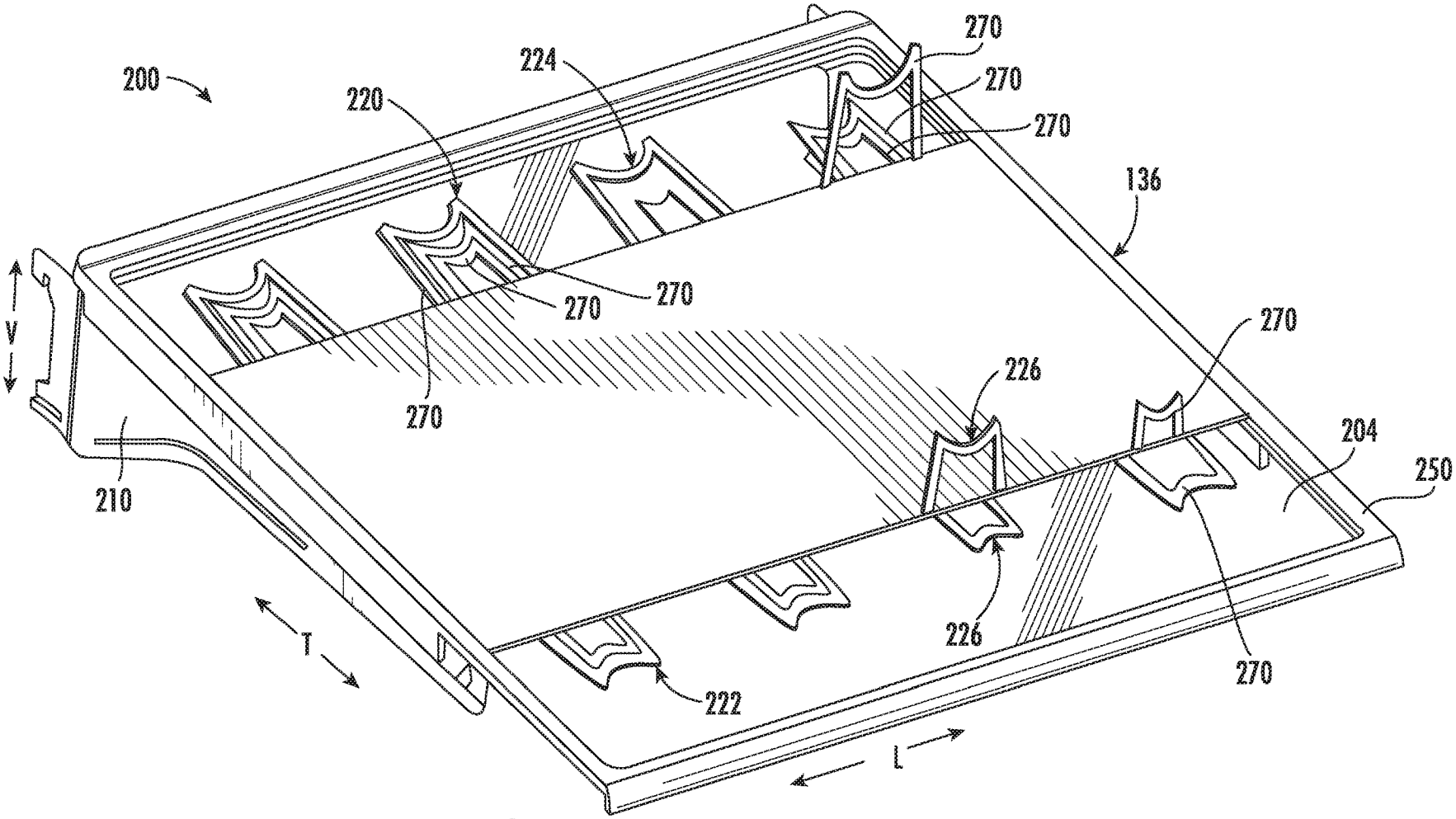
FIG. 6 provides a perspective view of a bottle support assembly that may be positioned on a shelf of the exemplary refrigerator appliance of FIG. 1 according to another exemplary embodiment of the present subject matter.

Referring now to FIG. 6, first support 220 and/or second support 222 may define a plurality of nested support structures 270. Each of the nested support structures may be independently pivoted relative to support panel 204. In the collapsed position, the innermost nested support structures 270 neatly fit within adjacent structures. However, the innermost nested support structures 270 may also define a smaller radius of curvature R than adjacent outer support structures 270. In this manner, a user may select one of the plurality of nested support structures 270 that best fits the size of the neck 230 and the base 232 of the wine bottle being stored.

Referring again generally to FIGS. 3 and 4, bottle support assembly 200 may include a drive mechanism 280 which is mechanically coupled to one or both of first support 220 and second support 222 for moving first support 220 and second support 222 between the collapsed position and the raised position. Specifically, drive mechanism 280 may include a drive belt 282 that is mechanically coupled to the first support 220 and the second support 222 via a gear assembly 284. In addition, drive belt 282 may be operably coupled to a slide bar 286 mounted on a front of support panel 204 or shelf 136. In this manner, when a user slides slide bar 286 along the lateral direction L, drive belt 282 engages gear assemblies 284 to pivot first support 220 and/or second support 222 between a collapsed and a raised position. It should be appreciated that other manual or automatic drive mechanisms are possible and within scope of the present subject matter.

Although bottle support assembly 200 is described herein as including two supports 220, 222 pivotally mounted to a support panel 204, it should be appreciated that variations and modifications may be made to bottle support assembly 200 according to alternative embodiments. For example, support panel 204 may form a bottom wall of a storage bin, supports 220, 222 may be configured for receiving more than three wine bottles 202, etc. Alternatively, first support 220 and second support 222 may be operably coupled to another drive mechanism for facilitating easy raising and lowering of supports 220, 222. As one skilled in the art will appreciate, the above described embodiments are used only for the purpose of explanation. Modifications and variations may be applied, other configurations may be used, and the resulting configurations may remain within the scope of the invention.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance comprising:

a cabinet defining a chilled chamber;

a door being operably coupled to the cabinet to provide selective access to the chilled chamber;

a bottle support assembly positioned within the chilled chamber, the bottle support assembly comprising:

a support panel;

a first support pivotally mounted to the support panel and being movable between a collapsed position and a raised position, the first support defining a first concave support surface for receiving a first end of a bottle when the first support is in the raised position; and a second support pivotally mounted to the support panel and being movable between a collapsed position and a raised position, the second support defining a second concave support surface for receiving a second end of the bottle when the second support is in the raised position, wherein the bottle support assembly comprises a drive mechanism mechanically coupled to the first support and the second support for moving the first support and the second support between the collapsed position and the raised position, the drive mechanism comprising:

a drive belt mechanically coupled to the first support and the second support; and a slide bar slidably mounted on a front of a shelf, the slide bar being mechanically coupled to the drive belt for moving the first support and the second support between a collapsed position and a raised position.

2. The refrigerator appliance of claim 1, wherein the first support defines a first height relative to a support panel when in the raised position and the second support defines a second height relative to the support panel when in the raised position, the first height being greater than the second height.

3. The refrigerator appliance of claim 1, wherein the first support and the second support are spaced apart substantially along a transverse direction, the first support being positioned proximate a rear of the cabinet and the second support being positioned proximate a front of the cabinet.

4. The refrigerator appliance of claim 1, wherein the first support defines a first plurality of concave support surfaces and the second support defines a second plurality of concave support surfaces for receiving a plurality of bottles.

5. The refrigerator appliance of claim 1, wherein the first support and the second support are secured in the raised position using a locking mechanism.

6. The refrigerator appliance of claim 5, wherein the locking mechanism comprises a protruding feature and a complementary recess, wherein the protruding feature is defined on either the support panel or the first support and the second support, and wherein the complementary recess is defined on the other of either the support panel of the first support and the second support.

7. The refrigerator appliance of claim 1, wherein the shelf is positioned within the chilled chamber, wherein the support panel is suspended above the shelf.

8. The refrigerator appliance of claim 7, wherein the shelf defines a raised lip for containing liquid spilled on the shelf.

9. The refrigerator appliance of claim 1, further comprising:

a storage bin slidably mounted within the chilled chamber, the bottle support assembly being positioned within the storage bin.

10. The refrigerator appliance of claim 1, wherein the support panel is a shelf or a bottom wall of a storage bin of the refrigerator appliance.

11. The refrigerator appliance of claim 1, wherein the bottle support assembly is constructed from plastic.

12. A bottle support assembly comprising:

a support panel;

a first support pivotally mounted to the support panel and being movable between a collapsed position and a raised position, the first support defining a first concave support surface for receiving a first end of a bottle when the first support is in the raised position;

a second support pivotally mounted to the support panel and being movable between a collapsed position and a raised position, the second support defining a second concave support surface for receiving a second end of the bottle when the second support is in the raised position, wherein the first support pivots in a first direction and the second support pivots in a second direction different from the first direction; and a drive mechanism mechanically coupled to the first support and the second support for moving the first support and the second support between the collapsed position and the raised position, the drive mechanism comprising:

a drive belt mechanically coupled to the first support and the second support; and a slide bar slidably mounted on a front of a shelf, the slide bar being mechanically coupled to the drive belt for moving the first support and the second support between a collapsed position and a raised position.

13. The bottle support assembly of claim 12, wherein the first support defines a first height relative to a support panel when in the raised position and the second support defines a second height relative to the support panel when in the raised position, the first height being greater than the second height.

14. The bottle support assembly of claim 12, wherein the first support defines a first plurality of concave support surfaces and the second support defines a second plurality of concave support surfaces for receiving a plurality of bottles.

15. The bottle support assembly of claim 12, wherein the first support and the second support are secured in the raised position using a locking mechanism comprising a protruding feature and a complementary recess, wherein the protruding feature is defined on either the support panel or the first support and the second support, and wherein the complementary recess is defined on the other of either the support panel of the first support and the second support.

* * * * *